United States Patent [19]

Einstabland et al.

[11] 4,030,864

[45] June 21, 1977

[54] APPARATUS FOR MAKING INCLINED HOLLOW CONCRETE COLUMNS USING SLIDING FORMWORK

[75] Inventors: Tomas Berge Einstabland, Asker; Torlak Opedal, Hosle, both of Norway

[73] Assignee: Ingenior F. Selmer A/S, Oslo, Norway

[22] Filed: June 24, 1975

[21] Appl. No.: 589,833

[52] U.S. Cl. ..... 425/65; 249/20; 264/32

[51] Int. Cl.[2] ..... E046 11/28

[58] Field of Search ..... 264/32–34; 249/20, 22; 425/63–65

[56] References Cited

UNITED STATES PATENTS

| | | | |
|---|---|---|---|
| 3,224,065 | 12/1965 | Cheskin | 264/34 |
| 3,252,199 | 5/1966 | Bossner | 264/32 |
| 3,425,659 | 2/1969 | Eriksson | 425/63 |
| 3,593,392 | 7/1971 | Lambertini | 425/63 |
| 3,632,079 | 1/1972 | Rohlf | 249/20 |
| 3,901,472 | 8/1975 | Ahlgren | 425/63 |

FOREIGN PATENTS OR APPLICATIONS

| | | | |
|---|---|---|---|
| 1,945,847 | 4/1971 | Germany | 425/63 |

*Primary Examiner*—Richard B. Lazarus
*Assistant Examiner*—John McQuade
*Attorney, Agent, or Firm*—Wenderoth, Lind & Ponack

[57] ABSTRACT

Apparatus for moulding inclined, free-standing hollow columns of concrete by means of sliding formwork is provided. Initially, there is formed a base structure, and a bottom section of the column to be formed is anchored thereto. In the bottom section of the column is positioned a combined support- and guiding means which is displaceably positioned firmly against the inside wall of the column and which furthermore is liftably arranged, in a known fashion such as by being biased to the moulded column section by means of liftjacks or the like. The support- and guiding means may be forcibly adjustable in the lateral direction during the continuous moulding of the column to control and if necessary adjust the direction of the formwork and thereby the column wall during the moulding of the same.

5 Claims, 6 Drawing Figures

APPARATUS FOR MAKING INCLINED HOLLOW CONCRETE COLUMNS USING SLIDING FORMWORK

BACKGROUND OF THE INVENTION

The present invention relates to an apparatus for making inclined hollow concrete columns, and more particularly for the continuous moulding of free-standing or self supported hollow concrete columns, the axis of which are inclined relative to the horizontal.

There are known methods and means for the continuous moulding of concrete columns, compact columns as well as hollow columns. In most methods are utilized various designs of sliding formwork. There is thus known sliding formwork for moulding vertical hollow concrete columns, wherein liftable jigs support the formwork and which during lifting define the inside and the outside walls of the column. The formwork serves thereunder for positioning the formwork equipment. In some designs the jig with the formwork is supported and lifted directly from the ground. There is however also known formwork whereby the moulded, partly solidified concrete serves as support for the formwork equipment. In this connection there are utilized preferably hydraulic jacks and rod elements which may form part of the concrete reinforcement and which are imbedded in the moulded concrete wall.

In connection with concrete structures there is frequently a need for inclined hollow columns of concrete. Such columns have hitherto usually been moulded in the vertical position using conventional formwork and thereafter been placed into the desired inclined position. There is known a method for sliding formwork casting of two or several columns at the same time and which thereby provide mutual support.

The problems in connection with the control and/or elimination of prevailing lateral forces in the column and in the formwork in connection with the oblique loads thereon have heretofore not been satisfactorily solved.

The present invention relates to a new Summary of The Invention system for the continuous "in situ" moulding and construction of inclined, free-standing hollow columns of concrete.

A particular object of the invention is to provide systems for the moulding of hollow concrete columns having large dimensions, and particularly destined for use in connection with concrete oil platforms for offshort use and including columns having for instance a diameter of 6 to 20 m and having a height of 100 to 150 m.

The system in accordance with the invention is thus of the kind utilizing sliding formwork, and whereby there is initially provided a base construction and a bottom section of the column anchored thereto. Within the bottom section of the column is positioned a combined support- and guiding means which is displacably positioned, but which is firmly biased against the inside wall of the column and is liftable in a known fashion by being anchored to the moulded part of the column by means of lift jacks or the like. The support-and guiding means are provided with power operated lateral adjustable means such that during the continuous moulding of the column it is possible adjust and control the direction of the moulded column.

The system of the invention may be of several embodiments. One embodiment comprises a carrier dimensioned to be inwardly positioned and guided in the column, which carrier is provided with slides or roller means, such that the carrier can be firmly biased against the inside of the moulded and solidified part of the column. The uppermost part of the carrier is provided with transverse cantilevered beams or yokes protruding laterally outside the column. These beams or yokes are provided with the sliding formwork for the moulding of the inside as well as the outside of the column. Directly above the column wall positioned jacks having lifting elements operable to be anchored into the moulded concrete wall and which serve to carry and lift the entire system.

In a preferred embodiment of the invention there is provided between the carrier and the lateral top support for the formwork a forcibly pivotable support stem operable to provide for the desired positioning and guiding of the formwork. Thus, it is impossible to control of the direction of the column as it is moulded.

BRIEF DESCRIPTION OF THE DRAWINGS

The invention shall be described in connection with the accompanying drawings, wherein.

DETAILED DESCRIPTION OF THE INVENTION

Figure 1:
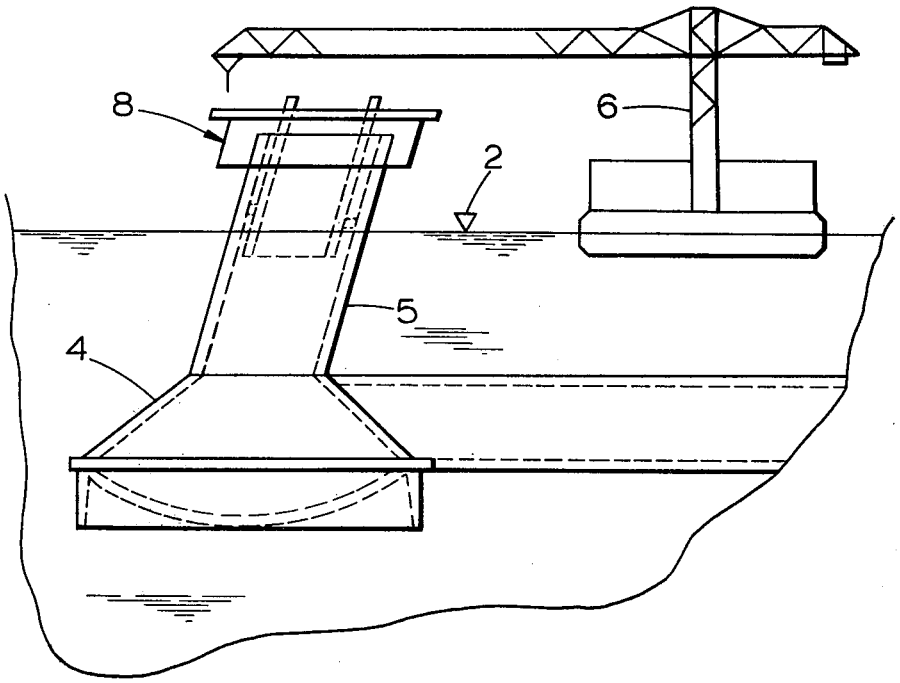
FIG. 1 is a diagrammatic view of a threepod rig structure having inclined hollow support columns which may be moulded in accordance with the invention.
Figure 2:
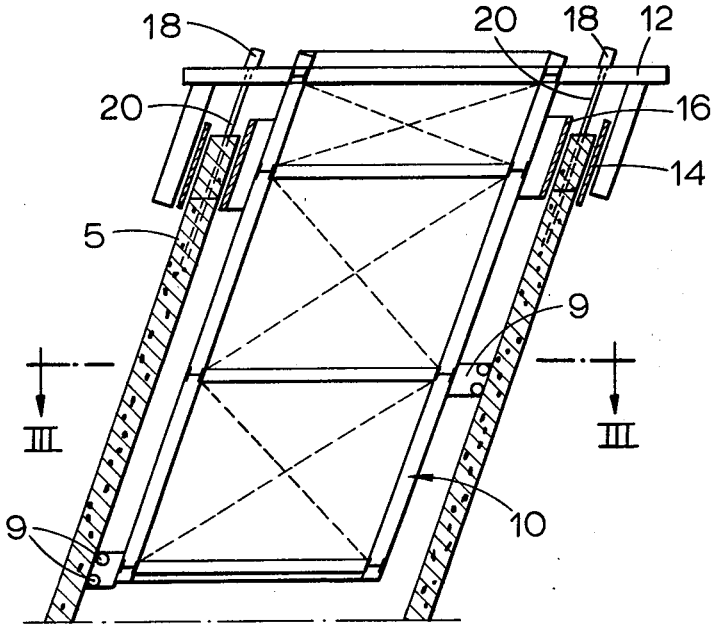
FIG. 2 is a vertical view, partly in section, and on an enlarged scale, of a part of an inclined column as shown in FIG. 1, and illustrating generally the sliding formwork in accordance with the invention.
Figure 3:
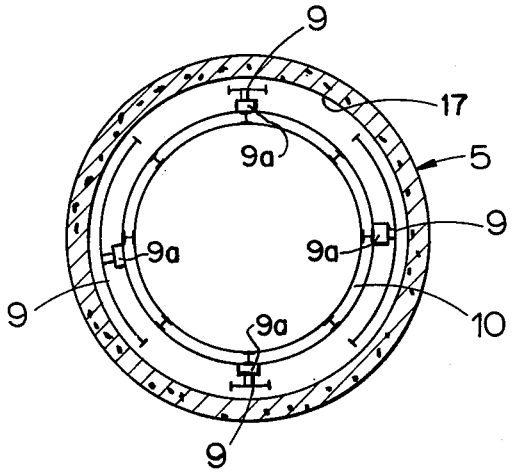
FIG. 3 is a horizontal section along the plane III—III in FIG. 2.

FIG. 1 shows, for the purpose of illustration, parts of an offshore platform structure having inclined columns, and shown during the building phase thereof. The illustrated platform is made by concrete moulding in a floating position, but it will be understood that the invention obviously can also be utilized with the same advantages for the moulding of hollow columns under other circumstances, for instance ashore. In the Figures the number 2 designated the sea surface, and the structure 4 of the platform forms base for a number, e.g. three, of to be molded hollow columns 5 which incline towards the vertical center line of the platform. A floating crane 6 (as well as other non-illustrated conventional equipment) is present during the construction for the supply of concrete and other operations. The number 8 designates generally the sliding formwork in accordance with the invention, and the same is shown in an enlarged scale in FIG. 2 which is a schematic vertical section through the structure. As shown in FIG. 2, on the inside of the column 5, as it is formed is positioned a stool or carrier 10, the effective height of which should be larger than the diameter of the column. Axially as well as circumferentially spaced on and around carrier 10 are a number of slides or roller units 9 which are biased against the inside wall of the column such that the carrier is hoistable and lowerable in the column. The slides or roller units 9 are forcibly adjustable in lateral directions thereof by means of hydraulic cylinders 9*a* or the like. As shown in FIG. 2, the roller units 9 are located at two levels of the carrier 10, both levels being at positions to contact the column 5 at solidified portions thereof. Thereby, the carrier may firstly be kept in desired engagement with the inside 17 of the column, and secondly the carrier can be angularly adjusted relative to the column axis.

On top of the carrier 10 are provided a number of circumferentially spaced, transverse yokes or beams 12 which serve as support for the annularly shaped sliding formwork having plates 14 and 16 which form the inside and the outside of the column wall, respectively. The sliding formwork furthermore includes circumferentially positioned conventional tightening means. This equipment may be of conventional type and therefore will not be described in detail.

On the beams 12, in the vicinity between the formwork plates 14 and 16, in a horizontal view, are provided circumferentially spaced suitably hydraulic or pneumatic jacks 18 for operating support rods such as armouring steel rods 20, the lower ends of which are positioned and anchored into the below positioned previously cast and solidified part of the column wall. The carrier 10 and the framework, i.e. the entire system, are supported by the rods 20 and are lifted gradually and intermittently upwards by means of the jacks 18. The rods 20 may be in one embodiment as mentioned be permanently imbedded as armouring in the column wall, but may alternatively be removed subsequent to completion of the moulding of the column. In the latter embodiment tube-shaped bushings are imbedded in and extend downwards into the column wall below the jacks on the beams 12, such that during moulding there are formed continuous tube-shaped passages down to the bottom of the column. The rods 20 are in this embodiment attached to the bottom of the column and extending upwards through the passages. As the column is being formed during the moulding operation, new sections of such carrying rods are added, and subsequent to the completion of the entire column the entire string of carrying rods may be drawn up and removed. Such carrying rods are preferably delivered in standard sections and are threaded together.

The described system operates in the following fashion.

Subsequent to formation of the base of the column, for instance a structure 4 as shown in FIG. 1, a on bottom section of the column is moulded in a conventional manner, for instance utilizing normal formwork plates. This foot section is however moulded such that it already has the desired column incline. Thereafter the carrier 10 with the formwork equipment as shown in FIG. 2 is lowered down into this foot section of the column, such that the form plates of the formwork overlap the top edge of the foot section of the column. Thereafter, the slides and/or roller units 9 are adjusted by operation of cylinders 9*a* such that the carrier attains exactly the desired angular position, whereafter the moulding of the inclined column can proceed by means of the equipment as described.

In order to reduce obliquness or distortions due to gravity and/or moment loads as much as possible, the carrier and the remainder of the system are, as shown in FIG. 2, constructed "obliquely", that is such that all upright members are positioned at an incline corresponding to the desired column incline, and such that all horizontal elements extend horizontally or substantially horizontally and thus are not normal to the axis of the column. Thus, there is obtained a desired and important horizontal concrete pouring surface. It will be understood that the entire system is supported by the free-standing inclined column. During the mouldng operation, it is possible to continuously control the column inclination to attain the correct and desired rectilinear shape. Corrections and compensations may be carried out by operation of cylinders 9a to adjust the position of the slides- and/or roller units 9 relative to the inside surface of the previously formed portion of the column.

Figure 4:
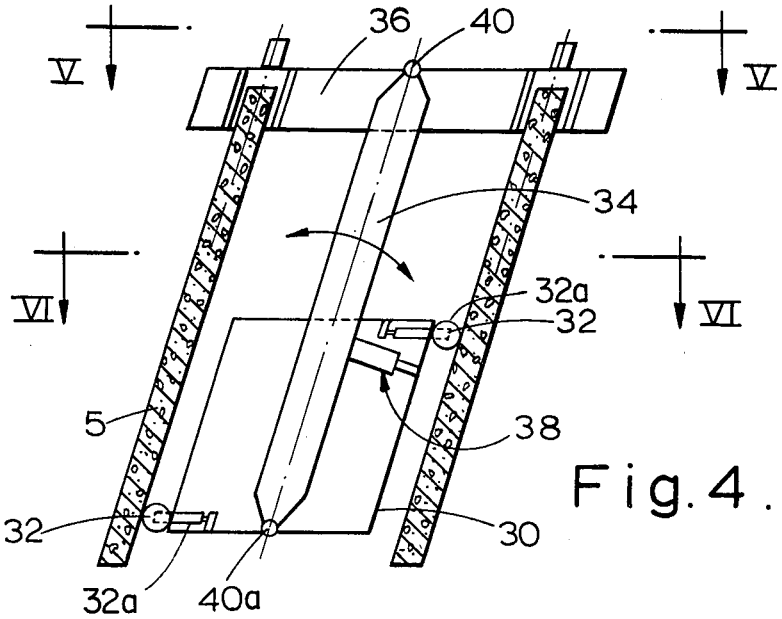
FIG. 4 is a vertical view similar to FIG. 2 of a preferred embodiment of the sliding formwork in accordance with the invention.
Figure 5:
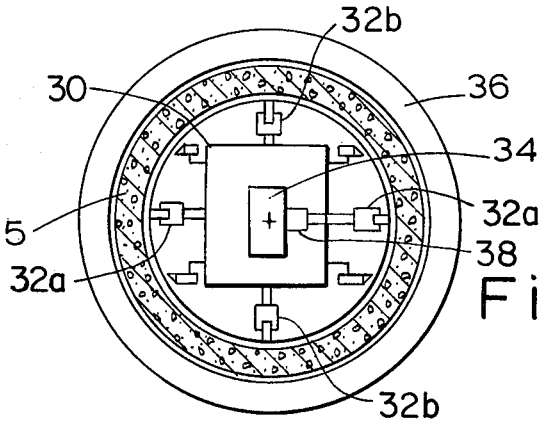
FIG. 5 is a horizontal view along the plane V–V in FIG. 4.
Figure 6:
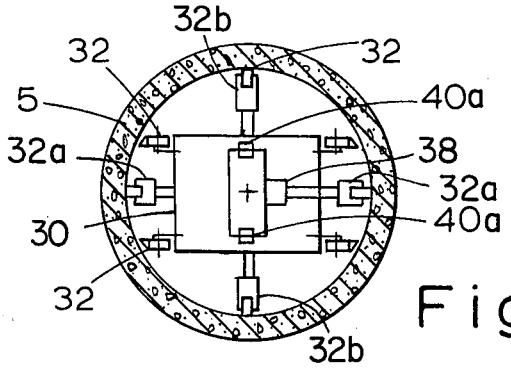
FIG. 6 is a horizontal sectional view along the plane VI-VI in FIG. 4.

FIGS. 4, 5 and 6 illustrate a modified embodiment of the carrier with the equipment depending therefrom. FIG. 4 is a view similar to FIG. 2, and shows a carrier which is somewhat shorter than the carrier 10 shown in FIG. 2, but which is provided with elevationally displaced, circumferentially distributed slides- and/or roller units 32 similar to units 9 shown in FIG. 2 In the lower part of the carrier 30 is pivotally supported at 40a a substantially upright support stem 34. On the top of stem 34 is likewise pivotally supported at 40 a platform unit 36 functionally corresponding to the beams 12 shown in FIG. 2. The sliding formwork equipment is mounted on the platform 36 and otherwise may be identical to the corresponding equipment shown in connection with FIG. 2. Between the support stem 34 and the carrier 30 is provided a power steering unit, such as pneumatic and/or hydraulic power cylinders 38. The platform 36 may in this embodiment pivot freely on tap shafts 40 since sufficient steering and guiding can be obtained by means of the cylinders 38, but if desired it would also be possible to position link connected jacks or the like between the support stem 34 and the platform 36. The embodiment shown in FIGS. 4–6 is operated in a manner similar to that of the embodiment shown in FIG. 2, but will be preferably in connection with most installations since it is possible to obtain a more effective guiding of the formwork and an improved compensation for prevailing oblique loads. For instance, by expanding cylinder 38 to pivot the support stem 34 to the left as shown in FIG. 4, the entire formwork system is pressed to the left, and due to the pivotal connection between the stem and the platform it is possible to avoid any changing of the relative inclined positioning of the formwork. In order to obtain optimal guiding and oblique load compensation at the pivot axes 40*a* and 40 of the support stem on the carrier 30 and on the platform 36, respectively, these pivot axes should extend normal to a vertical plane through the inclined column axis, i.e. the plane of the drawing. By adjustment, e.g. by cylinders 32*a*, of the slide- and/or roller units 32, it may however also be possible to obtain corrections/compensations in other directions. In order to obtain full lateral control it may be desireable to provide extra adjustability of the slide-roller means located on opposite side of the vertical plane through the column, e.g. by cylinders 32b.

The pivot tap shaft 40 between the support stem and the platform may be replaced with a centrally positioned spherical bearing whereby the platform including the formwork may adjust itself in all angular directions.

The hollow columns normally have a circular cross-section when viewed in a cross-sectional plane transverse to the column axis, but they may obviously be given other shapes, for instance circular about a horizontal plane inclined to the column axis. The invention may also be utilized for making hollow columns having other shapes such as polygonal, for instance rectangular.

We claim:

1. An apparatus for molding inclined free-standing hollow columns of concrete, said apparatus comprising:

a slip form unit positionable above an already formed solidified section of a column and serving as a mold for the formation of additional sections of the column;

a combined carrier and guide means supporting at an upper portion thereof said slip form unit, said carrier and guide means comprising a lower portion adapted to be positioned within the column, a support stem pivoted at the lower end thereto to said lower portion, and a platform pivoted to an upper portion of said stem, said slip form unit being supported by said platform;

means, mounted on said carrier and guide means and adapted to contact the inner surface of the already formed solidified section of the column, for imparting a lateral displacement to said carrier and guide means and to said slip form unit and for thereby controlling and adjusting the inclination of said slip form unit, with respect to the already formed solidified section of the column, for molding the next additional section of the column;

steering means between said lower portion of said carrier and guide means and said stem for selectively pivoting said stem about the pivot connection thereof with said lower portion; and means, operatively connected to said carrier and guide means, for raising said carrier and guide means and said slip form unit to positions for forming the next additional section of the column.

2. An apparatus as claimed in claim 1, wherein said stem is pivotally connected to said lower portion and to said platform about horizontal pivot axes extending normal to a vertical plane passing through the longitudinal axis of the column.

3. An apparatus as claimed in claim 1, wherein said stem is pivoted to said platform by a spherical journal.

4. An apparatus as claimed in claim 1, wherein said means for controlling and adjusting comprises at least two circumferentially spaced roller units attached to said lower portion and adapted to contact the inner surface of said column, said roller units being positioned in at least two separate elevational levels, and at least one of said roller units being laterally adjustable.

5. An apparatus as claimed in claim 3, wherein said means for controlling and adjusting includes at least one roller unit, mounted on said carrier and guide means, said roller unit being laterally adjustable in a direction parallel to the axis of the pivot connection between said stem and said lower portion.

* * * * *